US008752832B2

(12) United States Patent
Mitamura

(10) Patent No.: US 8,752,832 B2
(45) Date of Patent: Jun. 17, 2014

(54) SHEET CONVEYING APPARATUS

(71) Applicant: Canon Kabushiki Kaisha, Tokyo (JP)

(72) Inventor: Akiyuki Mitamura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/908,113

(22) Filed: Jun. 3, 2013

(65) Prior Publication Data

US 2013/0341851 A1 Dec. 26, 2013

(30) Foreign Application Priority Data

Jun. 22, 2012 (JP) ..... 2012-140381

(51) Int. Cl.
*B65H 5/00* (2006.01)

(52) U.S. Cl.
USPC ..... 271/264

(58) Field of Classification Search
CPC ..... B65H 2404/56; B65H 2404/563; B65H 2404/61
USPC ..... 271/264
See application file for complete search history.

(56) References Cited

U.S. PATENT DOCUMENTS

| | | | | |
|---|---|---|---|---|
| 4,114,870 | A * | 9/1978 | Di Blasio | 271/35 |
| 5,624,197 | A * | 4/1997 | Morikawa et al. | 400/629 |
| 7,755,355 | B2 | 7/2010 | Polzin | |
| 7,909,317 | B2 * | 3/2011 | Miyakoshi | 271/3.14 |
| 8,393,614 | B2 | 3/2013 | Mitamura | |
| 2003/0141654 | A1 * | 7/2003 | Nishikata et al. | 271/264 |
| 2005/0140078 | A1 * | 6/2005 | Fujiwara | 271/9.01 |
| 2009/0189340 | A1 * | 7/2009 | Aoi | 271/264 |

FOREIGN PATENT DOCUMENTS

| | | | |
|---|---|---|---|
| JP | 7-076438 | A | 3/1995 |
| JP | 2005-162354 | A | 6/2005 |

* cited by examiner

*Primary Examiner* — David H Bollinger
(74) *Attorney, Agent, or Firm* — Fitzpatrick, Cella, Harper & Scinto

(57) ABSTRACT

A sheet conveying apparatus includes: a first conveying guide that has a first conveying face of a conveying path; a second conveying guide that has a second conveying face opposed to the first conveying face; and a guide portion that is provided at any one of the first conveying guide and the second conveying guide, the guide portion has an elastic member that is fixed to one of the first conveying guide and the second conveying guide, and a rigid member that is provided on the face side of the elastic member on which the sheet passes and that has a surface more rigid than that of the elastic member, and the elastic member is deformed by pressing of the conveyed sheet when the sheet passes through the guide portion.

19 Claims, 12 Drawing Sheets

SHEET CONVEYING APPARATUS

BACKGROUND OF THE INVENTION

1. Field of the Invention

The present invention relates to a sheet conveying apparatus used in an image forming apparatus such as a copying machine and a printer and in an image reading apparatus such as a scanner.

2. Description of the Related Art

An image reading apparatus such as a scanner includes an image reading portion that reads an image of a sheet, and a sheet conveying apparatus that conveys the sheet from a sheet tray to the image reading portion. In addition, an image forming apparatus such as a printer includes an image forming portion that forms an image on a sheet, and a sheet conveying apparatus that supplies the sheet from a sheet tray to the image forming portion.

Such a sheet conveying apparatus is provided with a guide member that applies a force to the sheet to be conveyed by an elastic body.

For example, Japanese Patent Laid-Open No. 7-76438 discloses a biasing member which applies a force to a sheet to one side in a sheet conveying path using strength of stiffness of a film member, employing the thin film member formed of PET (polyethylene terephthalate) resin as an elastic body.

In addition, in Japanese Patent Laid-Open No. 2005-162354, a guide member which guides a sheet to a pivot shaft side of a sensor flag provided in a sheet conveying path using strength of stiffness of a film member, similarly employing the thin film member formed of PET (polyethylene terephthalate) resin as an elastic body, is provided. As described above, it is possible to reliably sense the sheet by the sensor flag by providing the guide member.

However, in the guide member based on the elastic body formed of the thin film member proposed hitherto, the guide member itself may be worn out by an edge of a leading end or trailing end of the passing sheet.

Particularly, the shape of the guide member of the related art described above has a bent portion which is convex with respect to the sheet passing face. When the number of passing sheets in such a shape gets larger, the bent portion may be worn out and sharpened by the passing sheet. In addition, when the worn-out proceeds, the downstream side of the sheet in the conveying direction is torn off from the bent portion of the guide member, and may be conveyed to the downstream in the sheet conveying apparatus with the sheet.

SUMMARY OF THE INVENTION

The invention has been made in light of the above problems, and it is desirable to provide a guide member with excellent wear resistance against a sheet, even while keeping strength of stiffness of an elastic member such as a resin film member.

According to a representative configuration of the invention in order to solve the above problems, a sheet conveying apparatus which conveys a sheet along a conveying path includes: a first conveying guide that has a first conveying face of the conveying path; a second conveying guide that has a second conveying face opposed to the first conveying face; and a guide portion that is provided at any one of the first conveying guide and the second conveying guide, the guide portion has an elastic member that is fixed to one of the first conveying guide and the second conveying guide, and a rigid member that is provided on the face side of the elastic member on which the sheet passes and that has a surface more rigid than that of the elastic member, and the elastic member is deformed by pressing of the conveyed sheet when the sheet passes through the guide portion.

Further features of the present invention will become apparent from the following description of exemplary embodiments with reference to the attached drawings.

BRIEF DESCRIPTION OF THE DRAWINGS

FIG. 3A illustrates a state of transmission driving when a sheet is transmitted into the apparatus, and FIG. 3B illustrates a shape when the sheet is conveyed further to the downstream side.

FIG. 8A illustrates the whole of the guide portion, and FIG. 8B is an enlarged cross-sectional view of a flexible area portion of the guide portion.

FIG. 11A is a perspective view, and FIG. 11B is a diagram illustrating a cross section taken along the conveying direction.

FIG. 12A illustrates the whole of the guide portion, and FIG. 12B is an enlarged cross-sectional view of a flexible area portion of the guide portion.

DESCRIPTION OF THE EMBODIMENTS

Hereinafter, embodiments of the invention will be described in detail with reference to the drawings.

Figure 1:
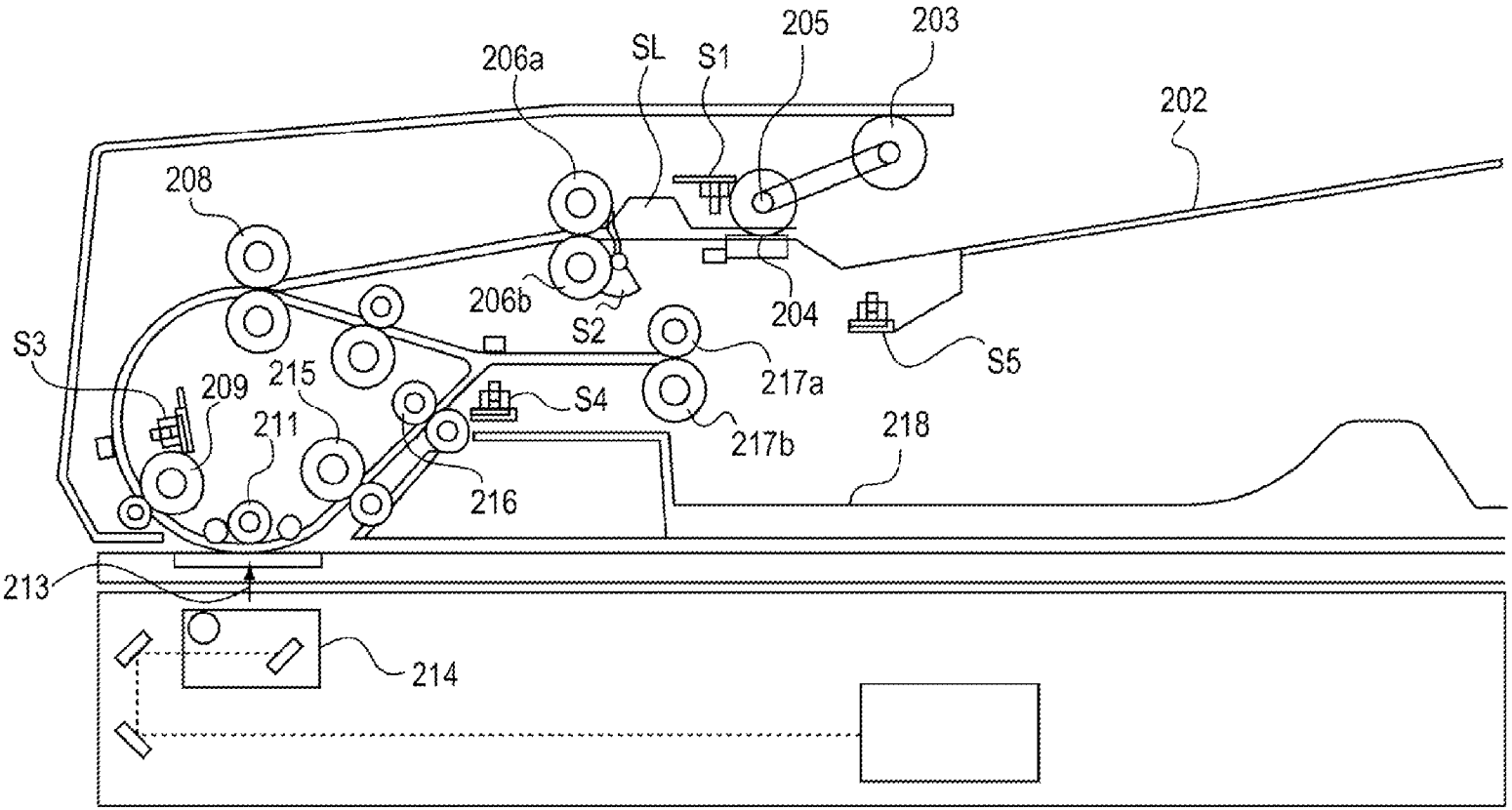
FIG. 1 is a cross-sectional view of a scanner apparatus according to a first embodiment of the invention.
Figure 2:
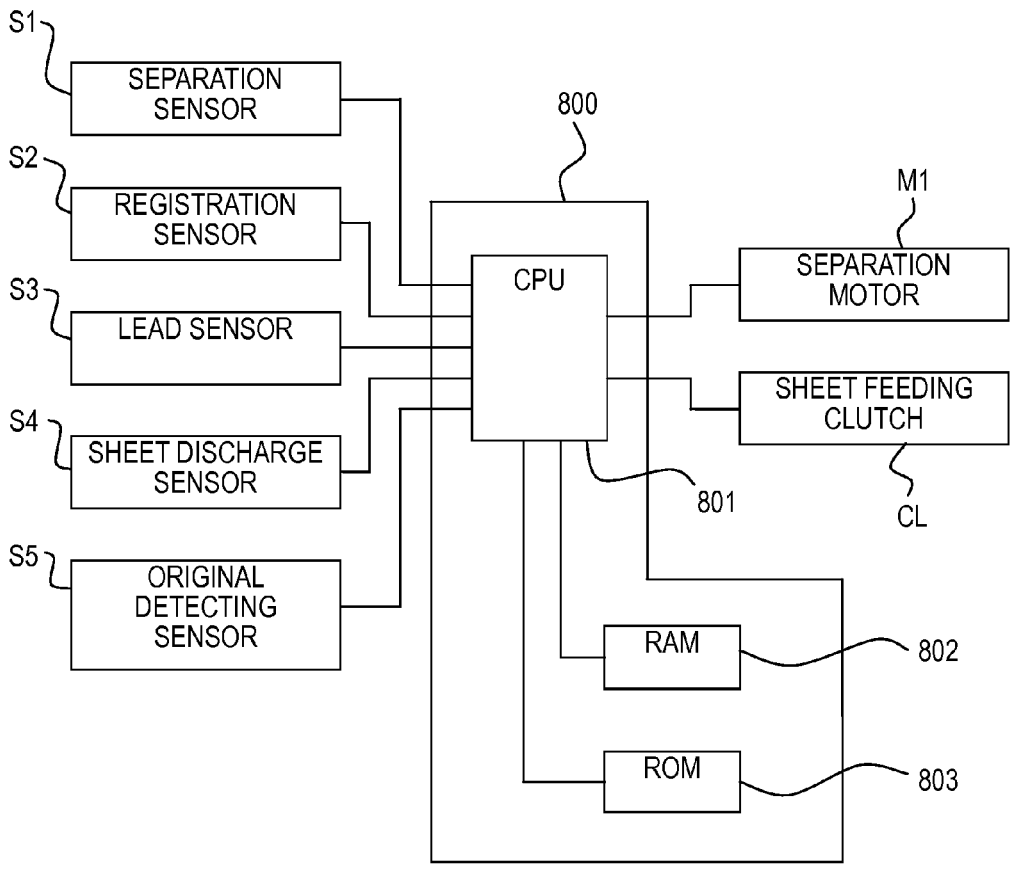
FIG. 2 is a block diagram illustrating a configuration of a main driving control system of the scanner apparatus illustrated in FIG. 1.

First Embodiment (Overall Configuration of Scanner Apparatus) FIG. 1 is a cross-sectional view illustrating a configuration of a scanner apparatus that reads an image of a sheet according to a first embodiment of the invention. In addition, FIG. 2 is a block diagram illustrating a configuration of a main driving control system of the scanner apparatus illustrated in FIG. 1.

When a sheet bundle is set on an original tray 202, it is determined that there is an original by an original detecting sensor S5. When a reading operation start is input by a user, a separation motor M1 is driven to drive a pickup roller 203 and a separation roller 205, and the sheet bundle is separated sheet by sheet by a separation pad 204 and is conveyed into the apparatus. In addition, a separation sensor S1 detects that the sheet is positioned at the separation roller 205.

When a leading end of the sheet reaches a registration sensor S2, the leading end of the sheet is conveyed by the separation roller 205 therefrom by a predetermined distance, and a loop is formed in a loop space SL of an upstream portion of a pinch roller 206*a* and a registration roller 206*b*. The leading end of the sheet bumps into the registration roller nip portion throughout a thrust width, to cause registration correction.

Thereafter, the leading end of the sheet is extracted by the pinch roller 206*a* and the registration roller 206*b*, and reaches a lead sensor S3 through a conveying roller 208.

When the leading end of the sheet reaches the lead sensor S3, a reading element such as a CCD is driven, and a reading operation of an image is started by an image reading portion 214 at the time when the leading end of the sheet reaches a reading position 213 opposed to a platen roller 211 through a first lead roller 209.

The image-read sheet is discharged to a discharge tray 218 through a second lead roller 215, a third lead roller 216, and discharge rollers 217*a* and 217*b*.

Meanwhile, when a trailing end of the sheet passes through the separation sensor S1, it is detected whether or not there is the original on the original tray 202. When it is determined that there is the original, the next transmission operation is started.

When it is determined that there is no original, the driving of the CCD and the like is stopped, the transmission operation is stopped, and a feeding clutch CL is powered such that a torque can be transmitted. In addition, the separation motor M1 is reversely rotated (a direction of rotating the registration roller 206*b* in a downstream direction), and the pickup roller 203 is picked up to an initial waiting position (a position illustrated in FIG. 1).

Furthermore, as illustrated in FIG. 2, the sensors, the separation motor M1, and the feeding clutch CL are input to a controller 800. The controller 800 includes a ROM 803 in which a program is stored, a RAM 802 that is used as a work area, and a CPU 801 executes the program.

Figure 3B:
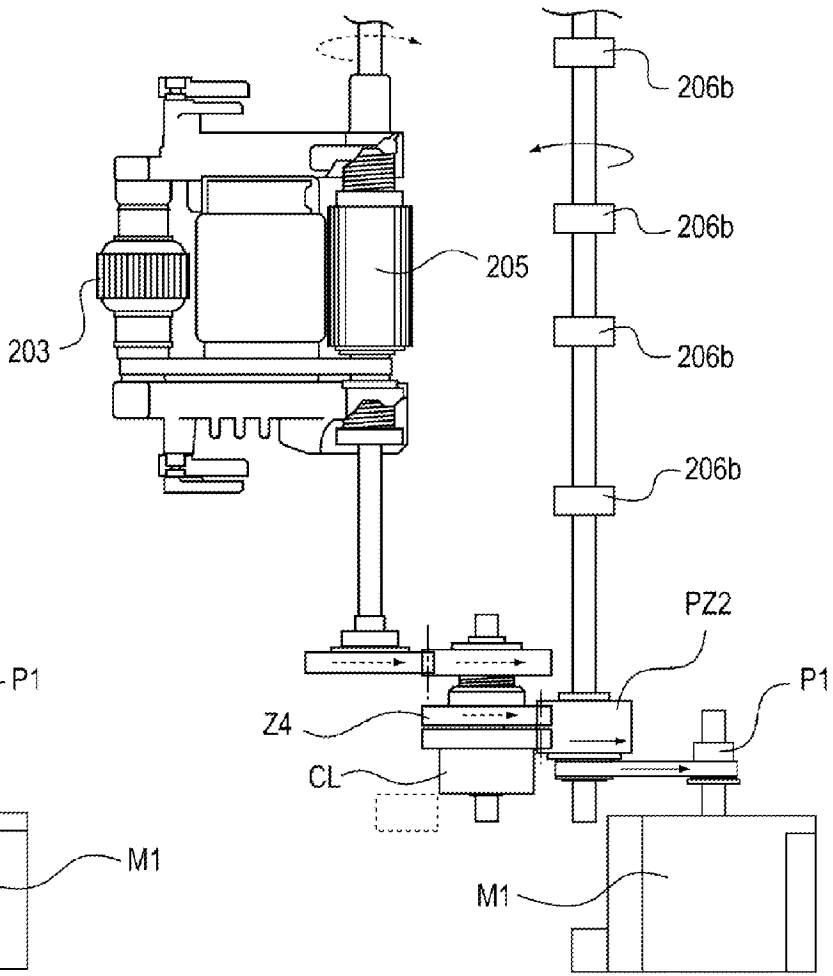
FIGS. 3A and 3B are diagrams illustrating a configuration of a driving system of a registration correction mechanism of the scanner apparatus illustrated in FIG. 1.
Figure 3A:
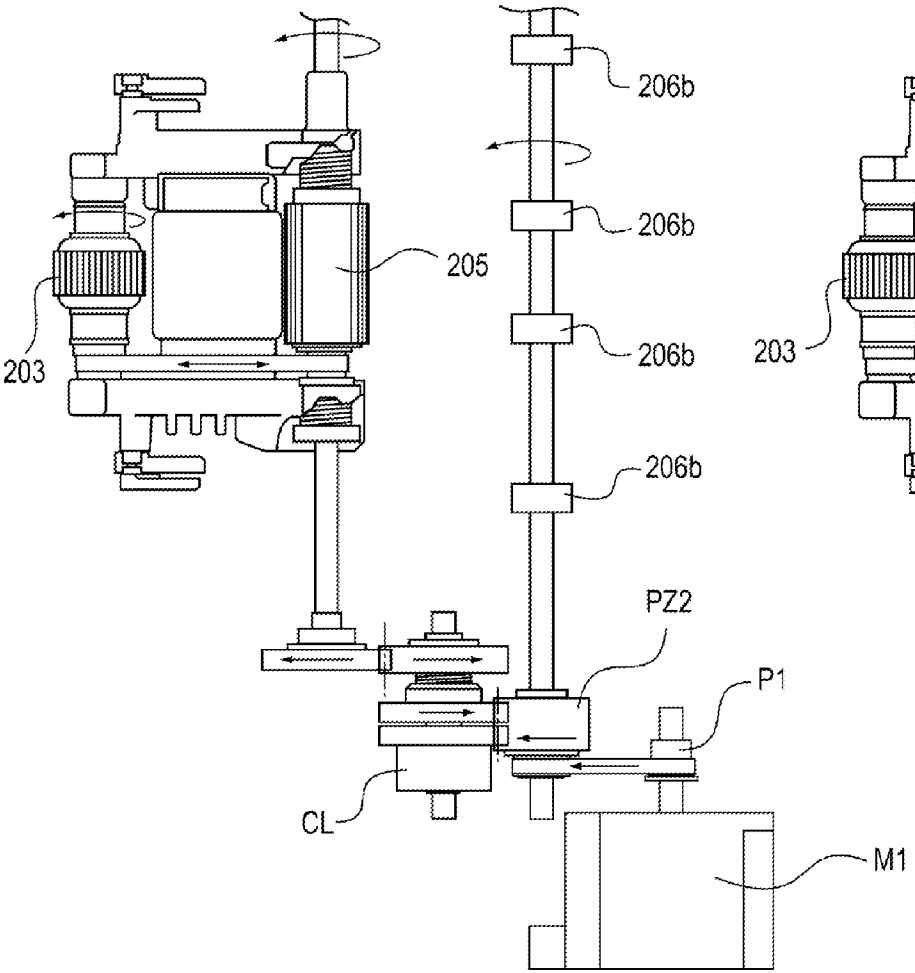

FIGS. 3A and 3B are diagrams illustrating a configuration of a driving system of the registration correction mechanism of the scanner apparatus illustrated in FIG. 1. FIGS. 3A and 3B are diagrams illustrating the scanner apparatus as viewed from the upside, and arrows denote recognizable movement directions or rotation directions as viewed from the upside.

The registration roller 206*b* is driven by the same driving source as that of the pickup roller 203 and the separation roller 205.

FIG. 3A illustrates a state of the transmission driving when the sheet is transmitted into the apparatus by the pickup roller 203 and the separation roller 205.

A pulley P1 of a first stage of the separation motor M1 rotates in the direction indicated by the illustrated arrow, and the registration roller 206*b* rotates in the direction indicated by the illustrated arrow, that is, a reverse direction to the conveying direction of the sheet based on the transmission driving, by a pulley gear PZ2 rotating with a registration roller shaft 206*s*.

FIG. 3B illustrates a state when the sheet is conveyed further to the downstream side by the registration roller 206*b* after the contact and registration correction to the registration roller 206*b* of the leading end of the sheet are completed by the transmission driving.

The pulley P1 of the first state of the separation motor M1 rotates in the reverse direction to the case of FIG. 3A, and the registration roller 206*b* rotates in the direction indicated by the illustrated arrow, that is, to convey the sheet in the downstream direction, by the pulley gear PZ2 rotating with the registration roller shaft 206*s*.

In this case, in FIG. 3A, a gear Z4 receiving the driving transmission from the pulley gear PZ2 and taking in charge of relay of the transmission driving includes the feeding clutch CL that is a one-direction clutch in an inner diameter side, and thus idles in the rotation direction of FIG. 3B to block the driving. In addition, the pickup roller 203 and the separation roller 205 idle along the sheet conveyed to the downstream side by the registration roller 206*b*.

The switching of the driving illustrated in FIGS. 3A and 3B, that is, the switching of the forward and reverse rotation of the separation motor M1 is performed according to whether or not there is the detection of the leading end of the sheet of the registration sensor S2.

Figure 4:
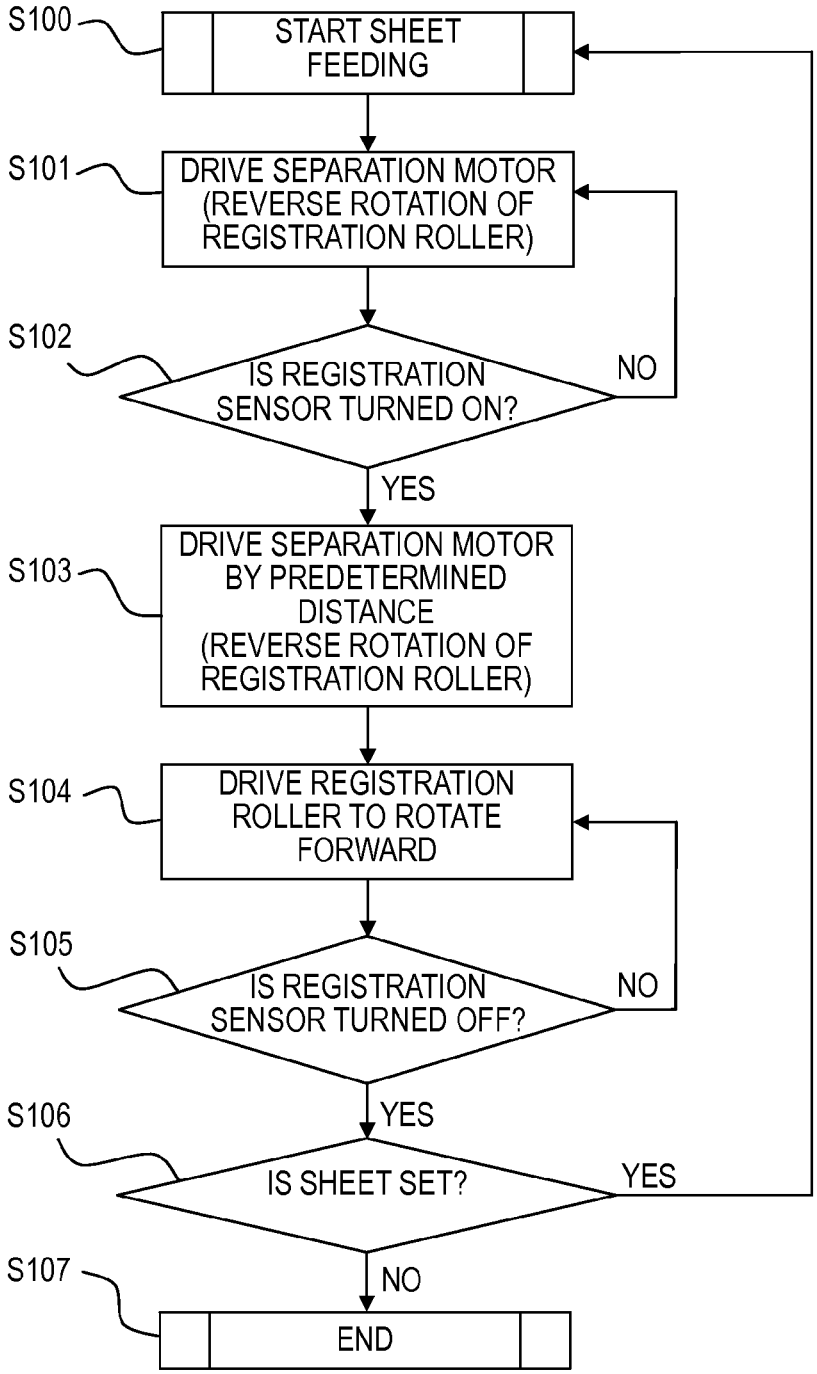
FIG. 4 is a flowchart illustrating a switching control of the forward and reverse rotation of a transmission motor that drives the registration correction mechanism of FIG. 3A and FIG. 3B.

FIG. 4 is a flowchart illustrating a switching control of the forward and reverse rotation of the separation motor M1.

When the transmission is started (Step S100), the separation motor M1 is driven in the direction illustrated in FIG. 3A (Step S101). When the reaching of the leading end of the sheet is detected by the registration sensor S2 (Step S102), the separation motor M1 is driven by a predetermined distance (Step S103), and then the separation motor M1 rotates to make the registration roller 206*b* rotate in the direction illustrated in FIG. 3B (Step S104).

When the sheet passes and the registration sensor S2 is turned off, the original detecting sensor S5 determines whether or not there is a sheet on the original tray 202 (Step S106). When there is a sheet, the transmission operation based on the pickup roller 203 is repeated (Step S100). When there is no sheet, the transmission operation is ended (Step S107).

In addition, after the registration sensor S2 detects the reaching of the leading end of the sheet, the sheet is further transmitted by a predetermined distance in the direction of the registration roller 206*b* by the transmission driving, but meanwhile, the registration roller 206*b* rotates in the reverse direction to the entry direction of the leading end of the sheet.

Figure 5:
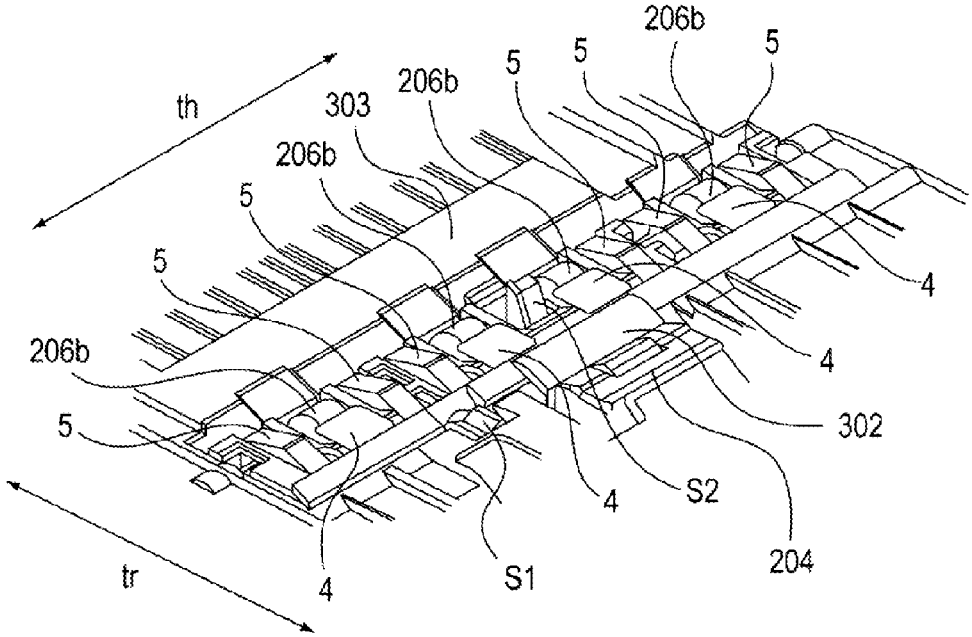
FIG. 5 is a perspective view illustrating a configuration of the registration correction mechanism and peripheral portions thereof according to the first embodiment of the invention.

(Configuration of Registration Mechanism Portion) FIG. 5 is a perspective view illustrating a configuration of the registration correction mechanism and peripheral portions thereof according to the embodiment.

In FIG. 5, a one-direction arrow represents the conveying direction tr, and a two-direction arrow represents a thrust direction th (a direction perpendicular to the conveying direction on the conveying direction face). On the downstream of the separation pad 204, a plurality of registration rollers 206*b* is disposed in the thrust direction (the direction perpendicular to the sheet conveying direction). The surface of the peripheral face of the registration roller 206*b* is formed of a material with a relatively high friction coefficient such as silicon and urethane. That is, the surface of the peripheral face of the pinch roller 206*a* has friction lower than that of the registration roller 206*b*.

The registration sensor S2 is disposed adjacent to the vicinity of the center of the registration roller 206*b* in the thrust direction such that it is possible to detect the leading end of the sheet substantially at the same time when the leading end of the sheet reaches the registration roller 206*b*. By providing the registration sensor S2, it is possible to improve precision of the transmission amount based on the transmission driving.

In addition, conveying lower guides 302 and 303 constitute the conveying faces (the first conveying face and the second conveying face) under the conveying path.

Figure 6:
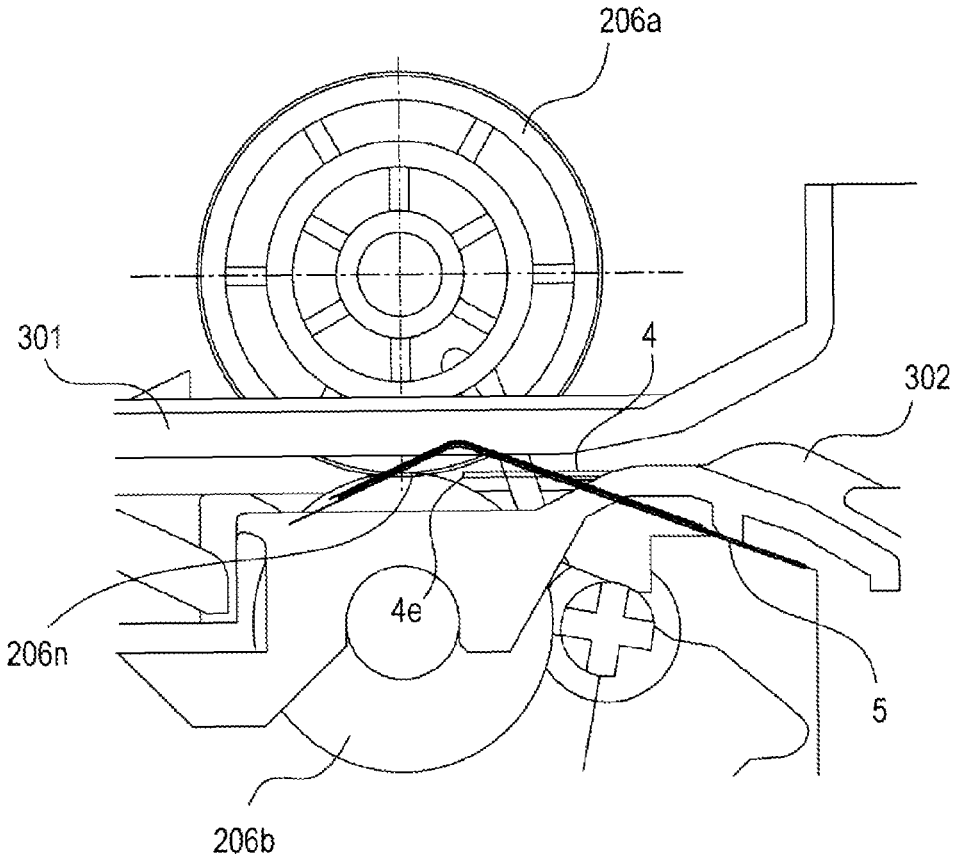
FIG. 6 is a cross-sectional view of the registration correction mechanism according to the first embodiment of the invention.

FIG. 6 is a cross-sectional view of the registration correction mechanism of the embodiment.

A conveying upper guide 301 (the first conveying guide) of FIG. 6 forms the upper conveying face (the first conveying face) above the conveying path, and the sheet is conveyed along the conveying path between the conveying lower guides 302 and 303 (the second conveying guides) forming the lower conveying face (the second conveying face) of FIG. 5, and the conveying upper guide 301 opposed thereto.

Most part of the surface of the registration roller 206*b* exposed from the conveying lower guide 302 is covered with a guide thin plate 4. For this reason, the possibility of the leading end of the sheet to come in contact with the surface of the registration roller 206*b* is restricted over the range between a leading end 4*e* of the guide thin plate 4 to a nip portion 206*n* of the registration roller 206*b*.

In thin paper (52 [g/m$^2$] or lower in basis weight) or a sheet, a leading end of which is bent (particularly, bent to the registration roller 206*b* side, hereinafter, referred to as leading end lower folded paper), only in the guide thin plate 4 of the guide of the leading end of the sheet to the nip portion 206*n* the leading end portion of the sheet is locally bent on the basis of the leading end 4*e* of the guide thin plate 4 as a pivot by the reversely rotating registration roller 206*b* at a gap from the leading end 4*e* of the guide thin plate 4 to the nip portion 206*n*.

As described above, since the leading end of the sheet is locally bent, the contact to the nip portion 206*n* is uneven for each of the plurality of rollers disposed in the thrust direction, and the registration correction is worsen.

Even in the thin paper or the leading end lower folded paper, in order to exhibit the registration correction function, a guide portion 5 is disposed on both sides in the thrust direction of the registration roller 206*b*, such that the leading end of the sheet is applied with a force to the pinch roller 206*a* side and the conveying upper guide 301 side even when it passes through the leading end 4*e* of the guide thin plate 4.

Figure 7:
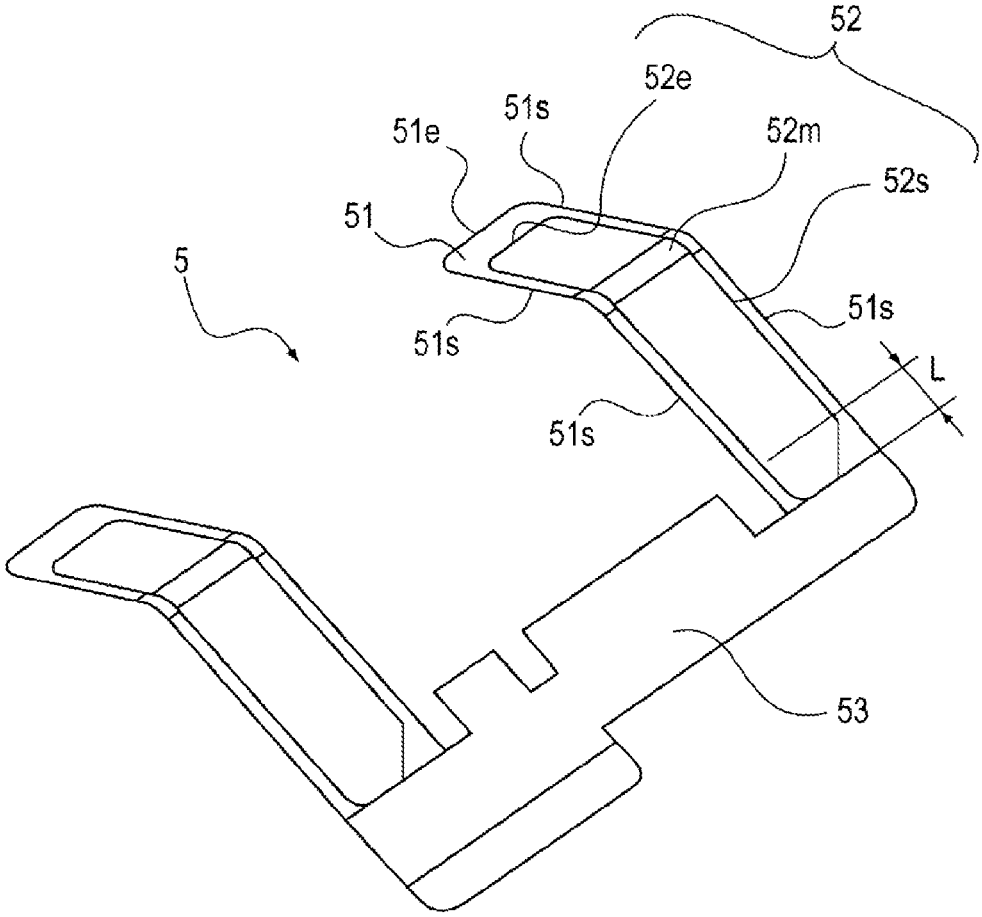
FIG. 7 is a perspective view illustrating a configuration of a guide portion according to the first embodiment of the invention.

(Configuration of Guide Portion) FIG. 7 is a perspective view illustrating a configuration of the guide portion 5.

The guide portion 5 is provided with a rigid member 52, a surface of which is more rigid than an elastic member 51, which is formed of a thin plate such as SUS of about 0.1 to 0.3 [mm] on the sheet passing face side of the elastic member 51 configured by a PET film sheet of about 0.1 to 0.2 [mm].

The sheet passing face side of the guide portion 5 is normally exposed to strong wear-out by the sheet passing, but it is possible to protect the guide portion 5 by forming the rigid member 52 with a metal thin plate such as SUS having excellent wear resistance.

In addition, the rigid member 52 has rigidity higher than that of the elastic member 51, and thus flexibility of the guide portion 5 is caused mainly by the elasticity of the elastic member 51.

A part of the rigid member 52 is fixed on the sheet-passing face side of the elastic member 51, but there is a method based on a double-sided tape or an adhesive as a fixing portion, or a method of fixing by allowing a heat-added and melted portion in the elastic member 51 to enter the unevenness surface of the metal in a state where the elastic member 51 formed of resin and the rigid member 52 formed of metal are overlapped.

In addition, in an area with a length L adjacent to an area adhered to the conveying lower guide 302, the elastic member 51 and the rigid member 52 are not fixed, and two members are separated. That is, the rigid member 52 is provided to be overlapped with the elastic member 51, is fixed and integrated to the elastic member 51 at a portion other than the area with the length L, is not fixed at the area portion with the length L but separated.

Figure 8A:
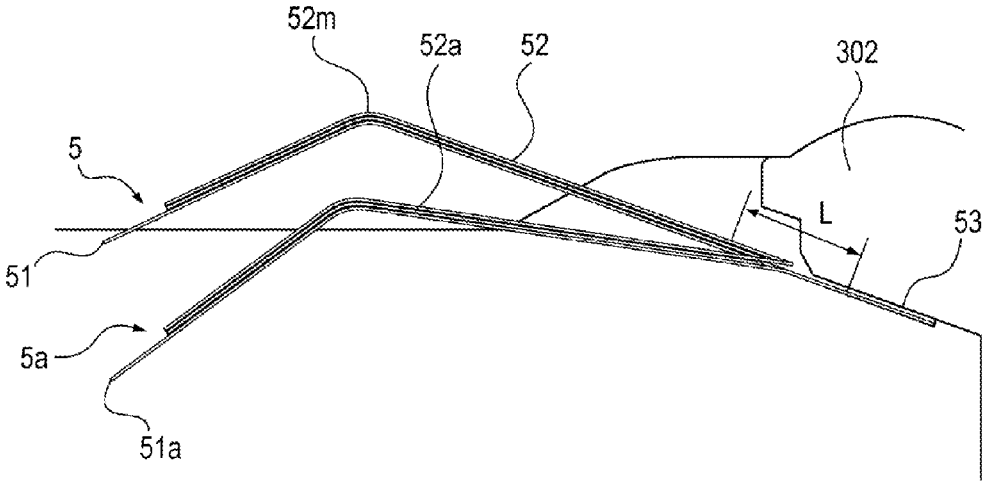
FIGS. 8A and 8B are cross-sectional views illustrating a cross section of the guide portion according to the first embodiment of the invention taken along a conveying direction of the sheet, and illustrate a state in which the guide portion is bent.
Figure 8B:
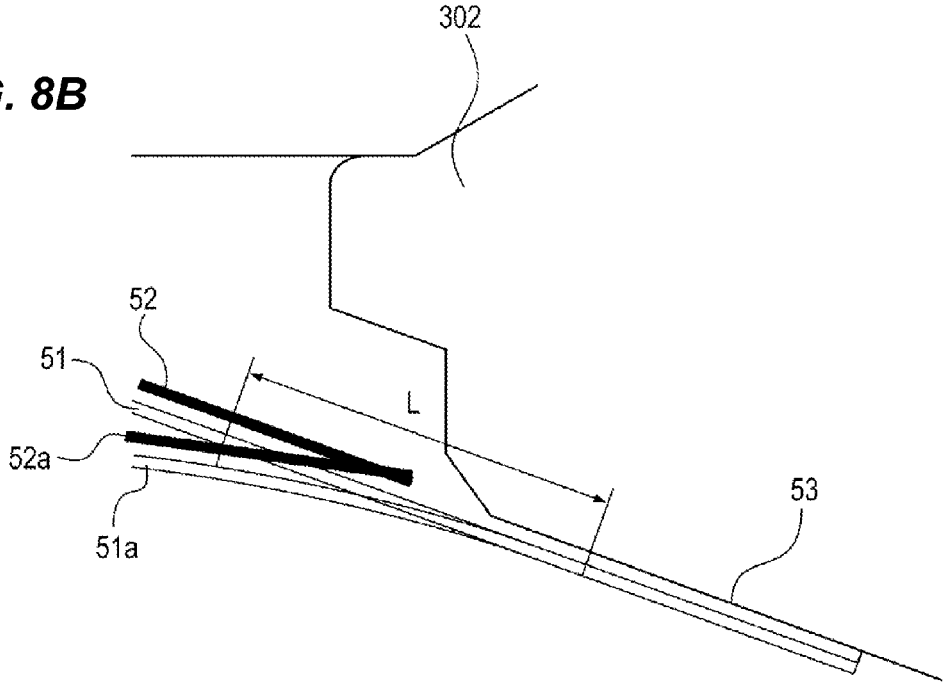

FIGS. 8A and 8B are cross-sectional views illustrating a cross section of the guide portion 5 taken along the conveying direction of the sheet, and illustrate a state where the guide portion 5 is bent. FIG. 8A illustrate the whole of the guide portion 5, and FIG. 8B is an enlarged cross-sectional view of the area portion with the length L of the guide portion 5.

As illustrated in these figures, the elastic member 51 may be bent at the area portion with the length L, and the guide portion 5 can be swung in a direction perpendicular to the conveying face by the elasticity of the bending direction of the elastic member 51. Accordingly, the guide portion 5 comes in contact with one face side of the sheet to be conveyed, and guides the sheet to apply a force to the other face side. In addition, the guide portion 5, the elastic member 51, and the rigid member 52 represent the bent members 5*a*, 51*a*, and 52*a*.

In addition, the elastic member 51 may be adhered to the conveying lower guide 302 by the adhesion portion 53 provided in the elastic member 51. A method of fixing to the conveying lower guide 302 may be a method of fixing by screws in addition to the adhesion based on the both-sided tape.

In addition, in the embodiment, the guide portion 5 may be adhered to the conveying lower guide 302, and applies a force to the sheet in the direction of the conveying upper guide 301. However, when the positional relation between the pinch roller 206*a* and the registration roller 206*b* is reversed, it may be adhered to the conveying upper guide 301, and a force may be applied to the sheet in the direction of the conveying lower guide 302. That is, the guide portion 5 is provided on one side of the conveying upper guide 301 and the conveying lower guide 302, and to apply a force to the sheet to the other side.

The elastic member 51 is about 6 to 7 [mm] in width (the length in the direction perpendicular to the sheet conveying direction), and is disposed in total six places (two or more places) on both sides of the registration roller 206*b* disposed in the thrust direction (the direction perpendicular to the conveying direction of the sheet).

The elastic force of the guide portion 5 is obtainable by the elasticity of the elastic member 51 in the non-integration area with the length L.

In addition, the elastic force of the guide portion 5 is set to be stronger than rigidity of the thinnest paper on specifications of the scanner apparatus with the same width, and to be lower than the rigidity in the whole width (all the guide portions 5) of the thickest paper on the specifications.

The reason is as follows. That is, since the leading end of the thin paper is easily deformed in a wavy shape in the direction perpendicular to the conveying face, it is necessary to apply a force to the pinch roller 206*a* without coming in contact with the surface of the registration roller 206*b*; meanwhile, it is necessary to prevent that the conveying is not performed after the registration correction because the leading end of the thick paper is not easily deformed in the wavy shape, the elastic force that thrusts the guide portion 5 to the registration roller 206*b* side becomes an obstacle, and thus the leading end does not enter the nip portion 206*n*.

When it is assumed that the guide portion 5 is formed of only the rigid member 52 made of metal, it is necessary to make the thickness of the metal thin plate very thin.

The Young's modulus of the resin film, particularly, the PET film sheet, as the elastic member 51 used in the invention is about 4 [GPa], and meanwhile the Young's modulus of the SUS material as the metal thin plate is about 200 [GPa].

The thickness of the PET film sheet is 0.1 to 0.2 [mm] such that the stiffness of the guide portion 5 is stronger than the rigidity of the thinnest paper on the specifications of the scanner apparatus, and is lower than the rigidity of the thickest paper in the whole width on the specifications.

Simply assuming that the rigidity is correlation of curvature with respect to load, in order to obtain the equivalent rigidity using the metal thin plate, it is necessary for the case of the SUS thin plate that the thickness be thinner than the case of the PET film sheet by bulk, thereby being 27.1 to 54.3 [μm].

In any cases, in order to obtain the elastic force of the guide portion 5 using the metal thin plate, the thickness of the metal thin plate is necessarily very thinner than that of the PET film sheet.

In such a thickness, the end portion of the metal thin plate is sharpened, and the passing sheet surface or the end portion may be damaged. In addition, since the metal thin plate is very thin, workability is worsened, and a component cost may be raised.

For the reasons, the elastic force of the guide portion 5 according to the invention is obtained by the elastic member 51.

The guide portion 5 has a convex bent portion 52*m*, and applies a force to the sheet. The bent portion 52*m* of the rigid member 52 comes in contact with the sheet, and thus it is possible to apply a force to the sheet without adding a defect onto the surface of the guide portion 5 during the sheet passing. In addition, since the rigid member 52 has high rigidity, the shape of the bent portion 52*m* is less likely to be deformed by the passing of the sheet. That is, since the rigid member 52 includes the bent portion 52*m*, the bent shape is less changed even when the sheet is repeatedly passed. Accordingly, it is possible to appropriately apply a force to the sheet.

In addition, it is possible to reduce possibility that the sheet is erroneously flipped up by being jammed at a downstream side end portion 51*e* of the guide portion 5 in cases such as when paper jam occurs and the sheet congested in the conveying path is removed.

In addition, since the guide portion 5 has the bent portion 52*m*, the sheet may come in contact with the side face end portion 51*s* in the width direction opposite to the sheet passing face side of the side face on the downstream side from the bent portion 52*m*.

When the sheets with various widths are conveyed, it is conceivable that the end portion of the sheet in the width direction substantially coincides with the side face end portion 51*s* of the guide portion 5 in the width direction. In such a case, particularly when the sheet is obliquely conveyed, the sheet end portion is more likely to come in contact with the side face end portion 51*s* on the downstream side from the bent portion 52*m* of the guide portion 5.

In addition, when the sheet with open punch holes in the vicinity of the end portion is conveyed, the bent portion 52*m* may enter into the punch hole, and thus the side face end portion 51*s* including the bent portion 52*m* may be seized to cause paper jam, or the sheet may be torn off from the punch hole.

Even in such a case, in the embodiment, the width of the elastic member 51 is wider than the width of the rigid member 52. For this reason, the side face end portion 52*s* of the rigid member 52 is positioned on the more inner side than the side face end portion 51*s* of the elastic member 51. Accordingly, the side face end portion 51*s* on the downstream side from the bent portion 52*m* becomes the elastic member 51, and the sheet does not come in contact with the side face end portion of the rigid member 52 even when the end portion of the sheet comes in contact, and thus possibility of damage is low.

If the side face end portion 51*s* on the downstream side from the bent portion 52*m* is the end portion of the rigid member 52, and particularly, in a case of the metal thin plate such as the SUS thin plate, the end portion of the sheet passing face side is a sagging side, but the opposite side is a valley side, and possibility of damaging the end portion of the sheet is high.

As compared with the valley of the metal thin plate, the valley of the end portion of the PET film sheet is minor, and thus possibility of damaging the end portion of the sheet is low.

In addition, the downstream side end portion 52*e* of the rigid member 52 is positioned on the more inner side from the downstream side end portion 51*e* of the elastic member 51. Accordingly, when the sheet is removed when the sheet jam occurs, it is possible to prevent the sheet from being jammed at the downstream side end portion 52*e* of the rigid member 52.

Second Embodiment

Next, a scanner apparatus according to a second embodiment of the invention will be described.

Figure 9:
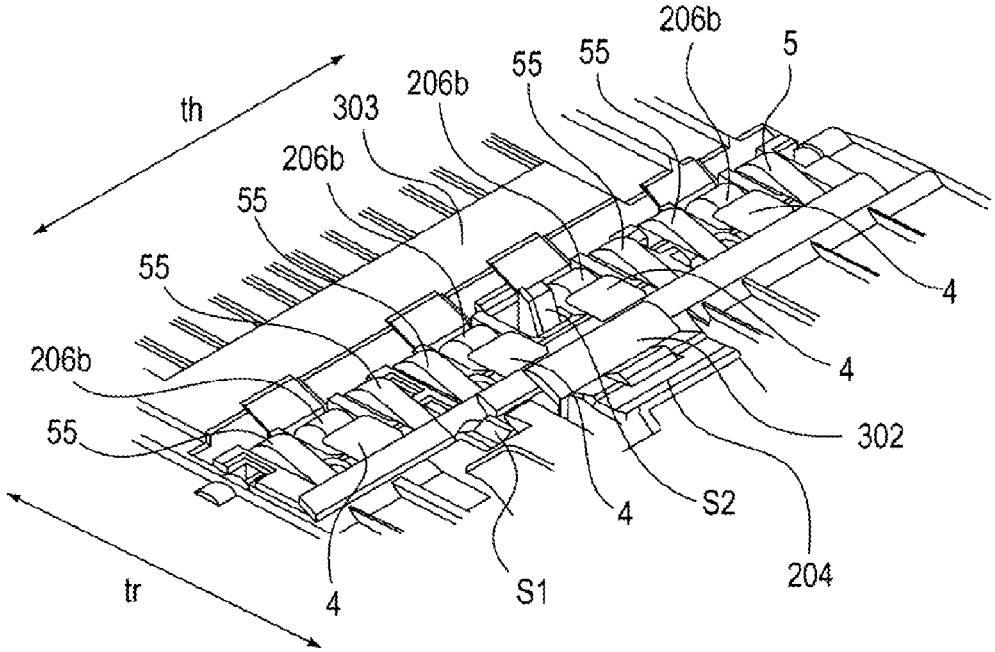
FIG. 9 is a perspective view illustrating a configuration of a registration correction mechanism and peripheral portions thereof of a scanner apparatus according to a second embodiment of the invention.

(Configuration of Registration Correction Mechanism) FIG. 9 is a perspective view illustrating a configuration of a registration correction mechanism of a scanner apparatus and peripheral portions thereof according to the embodiment. In the figure, the same reference numerals and signs are given to the same or similar portions as the configurations of the first embodiment, and the repeated description is not provided. In addition, the portions other than the configuration illustrated in FIG. 9 are the same as those of the first embodiment, and the repeated description is not provided.

In the figure, a separation pad 204 and a registration roller 206*b* are sequentially disposed in the conveying direction tr. In addition, in the thrust direction th that is the direction perpendicular to the conveying direction on the conveying direction face, a plurality of registration rollers 206*b* and a registration sensor S2 are disposed.

In addition, a guide portion 55 is provided on both sides of the registration roller 206*b* in the thrust direction th.

Figure 10:
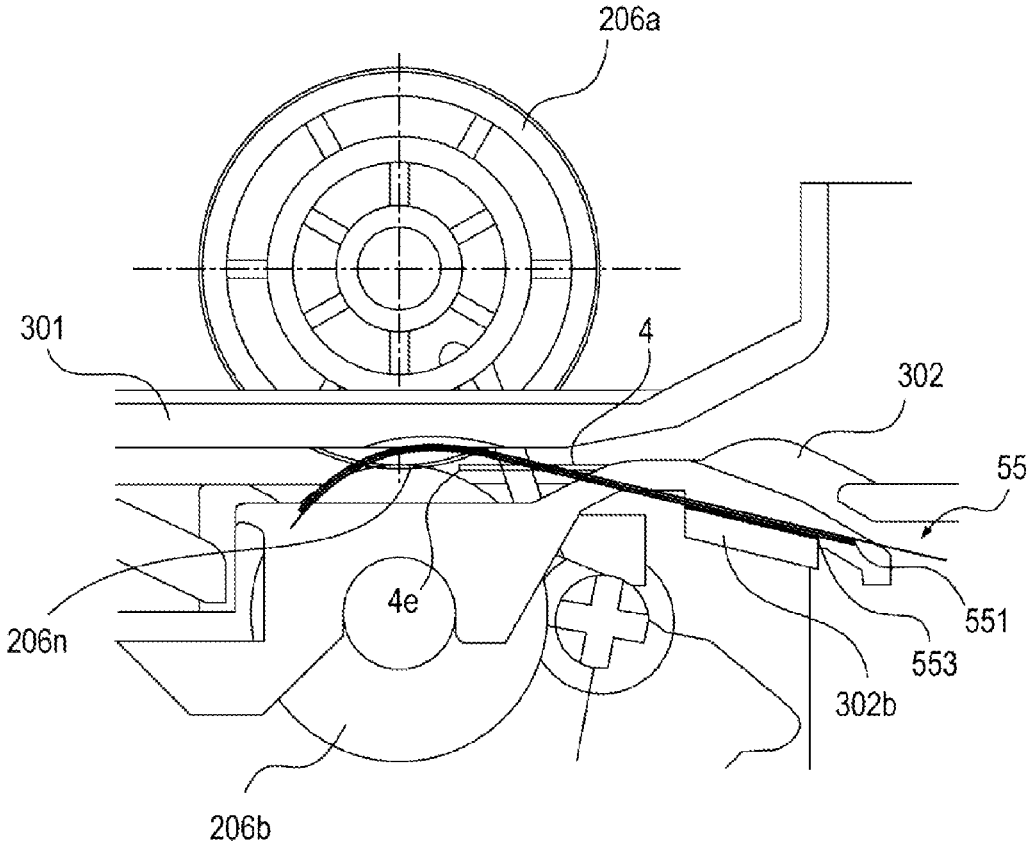
FIG. 10 is a cross-sectional view of the registration correction mechanism according to the second embodiment of the invention.

FIG. 10 is a cross-sectional view of a registration correction mechanism of the embodiment.

As illustrated in the figure, the guide portion 55 is adhered to a conveying lower guide 302*b* by an adhesion portion 553 provided on the face of the opposite side to the sheet passing face of a rigid member 552.

Figure 11A:
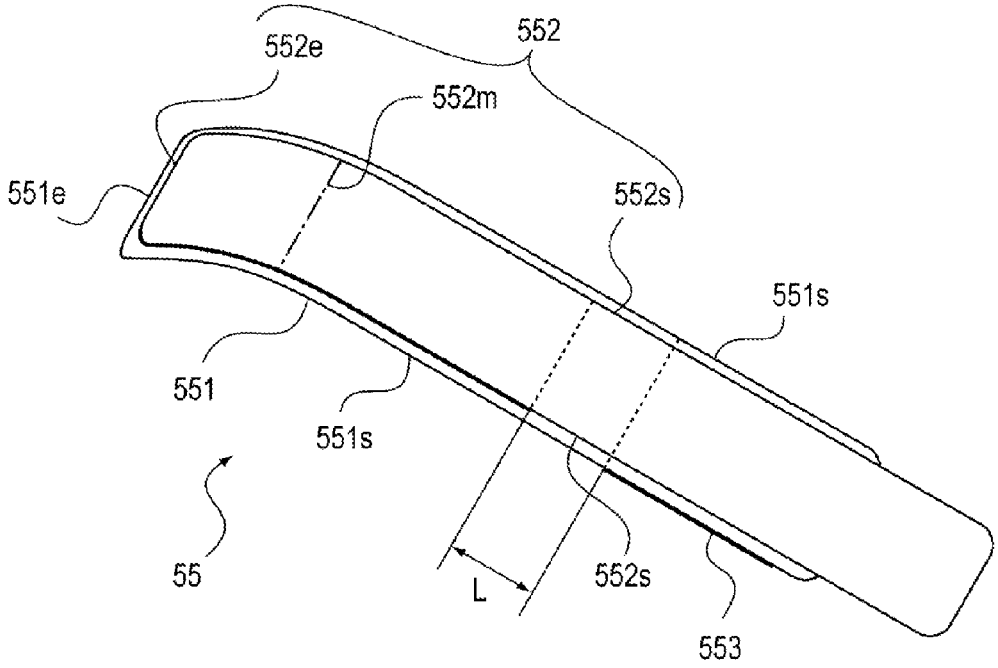
FIGS. 11A and 11B are diagrams illustrating a configuration of the guide portion according to the second embodiment of the invention.
Figure 11B:
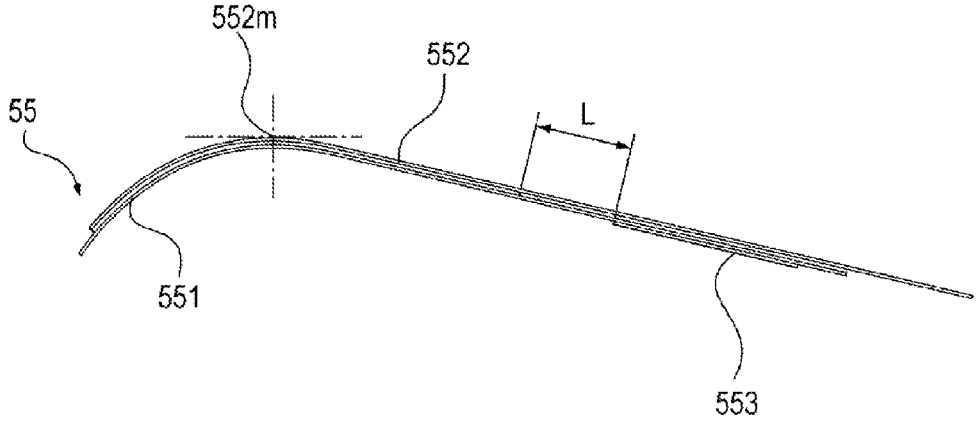

(Configuration of Guide Portion) FIGS. 11A and 11B are diagrams illustrating a configuration of the guide portion 55. FIG. 11A is a perspective view, and FIG. 11B is a diagram illustrating a cross section taken along the conveying direction.

As illustrated in these figures, the guide portion 55 has a configuration in which an elastic member 551 of about 0.1 to 0.2 [mm] and the rigid member 552 formed of a SUS thin plate of about 0.1 to 0.3 [mm] are integrated.

Even in the embodiment, the metal thin plate such as SUS with excellent wear resistance is disposed on the sheet passing face side, and thus it is possible to protect the guide portion 55 from being worn out to be exposed due to the sheet passing.

Even in the method of adhering the elastic member 551 and the rigid member 552, similarly to the first embodiment, there may be used a method based on a double-sided tape or an adhesive, or a method of integrating by allowing a heat-added and melted portion in the elastic member 551 to enter the unevenness surface of the metal in a state where the elastic member 551 formed of resin and the rigid member 552 formed of metal are overlapped.

In addition, there is the non-integrated portion only by the length L, and it is separated at this portion.

That is, the elastic member 551 and the rigid member 552 are not adhered in the area with the length L, the elastic member 551 may be bent in this area, and the guide portion 55 can be swung up and down in the direction perpendicular to the conveying face by the elasticity based on the bending of the elastic member 551.

Figure 12A:
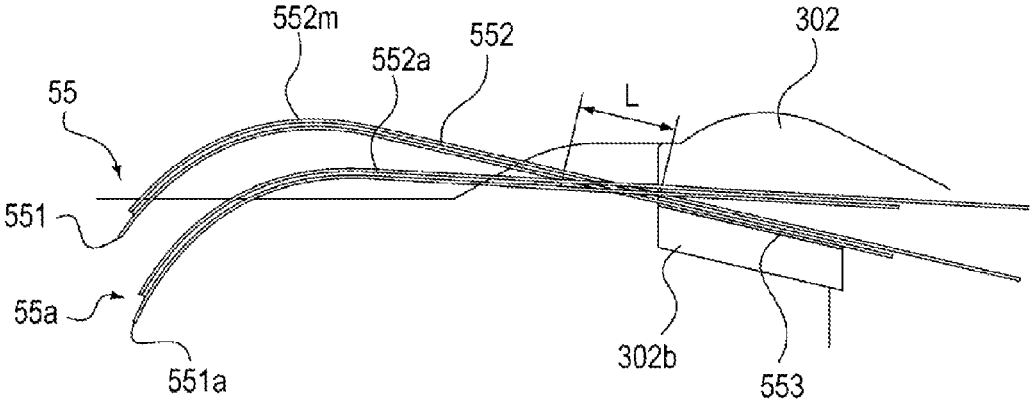
FIGS. 12A and 12B are diagrams illustrating a cross section of the guide portion according to the second embodiment of the invention taken along the conveying direction of the sheet, and illustrate a state in which the guide portion is bent.
Figure 12B:
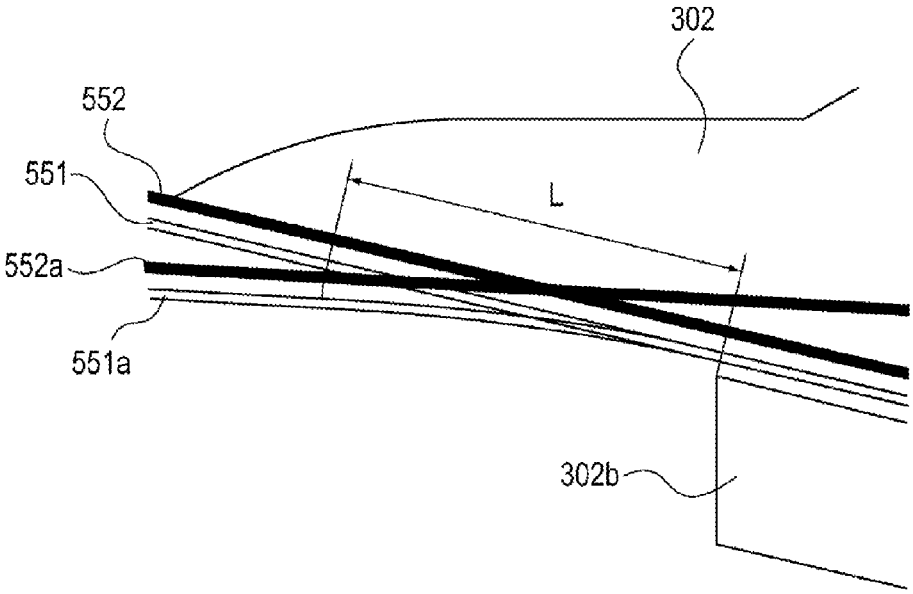

FIGS. 12A and 12B are diagrams illustrating a cross section of the guide portion 55 taken along the conveying direction of the sheet, and illustrate a state in which the guide portion 55 is bent. FIG. 12A illustrates the whole of the guide portion 55, and FIG. 12B is an enlarged cross-sectional view of an area portion with the length L of the guide portion 5.

As illustrated in these figures, the elastic member 51 may be bent at the area portion with the length L, and the guide portion 5 can be swung up and down in the direction perpendicular to the conveying face by the elasticity of the elastic member 51 in the bending direction. In addition, the guide portion 55, the elastic member 551, and the rigid member 552 represent the bent members 55*a*, 551*a*, and 552*a*.

The width of the elastic member 551 is about 6 to 7 [mm], and the elastic force of the guide portion 55 is obtainable by the elasticity of the elastic member 51 in the non-integrated area with the length L.

In addition, similarly to the guide portion 5 of the first embodiment, the elastic force of the guide portion 55 is set to be stronger than the rigidity of the thinnest paper on specifications of the scanner apparatus with the same width, and to be lower than the rigidity in the whole width (all the guide portions 55) of the thickest paper on the specifications.

By such an elastic force, in the thin paper, the leading end of which is easily deformed in a wavy shape in the direction perpendicular to the conveying face, a force can be applied to the pinch roller 206*a* side without coming in contact with the surface of the registration roller 206*b*. In addition, in the thick paper, the elastic force thrusting the guide portion 55 to the registration roller side becomes an obstacle, the leading end does not enter the nip portion 206*n*, and it is possible to prevent that the conveying after the registration correction is not performed.

In addition, similarly to the first embodiment, even in the embodiment, the width of the elastic member 551 is wider than that of the rigid member 552, a side face end portion 551*s* on the downstream side from a curved portion 552*m* becomes the elastic member 551, and possibility that the guide portion 55 is damaged is low even when the end portion of the sheet comes in contact. That is, the side face end portion 552*s* of the rigid member 552 is positioned on the more inner side from the side face end portion 551*s* of the elastic member 551, and thus it is possible to prevent the sheet from being jammed at the side face end portion 552*s* of the rigid member 552 at the time of conveying.

In addition, a downstream side end portion 552*e* of the rigid member 552 is positioned on the more inner side from a downstream side end portion 551*e* of the elastic member 551. Accordingly, in a case where the sheet jam occurs, when the sheet is removed, it is possible to prevent the sheet from being jammed at the downstream side end portion 552*e* of the rigid member 552.

The guide portion 55 has the curved portion 552*m*, and applies a force to the sheet. The curved portion 552*m* is about R10, as illustrated in 552*m* of FIGS. 11A and 11B, the sheet comes substantially in linear contact in the width direction, but the linear contact position (the contact position) moves to the upstream side when the guide portion 55 is pushed and bent by the sheet. By such a shape, it is possible to prevent the local wear-out based on the sheet conveying, and thus it is possible to further improve the wear resistance of the guide portion 55.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-140381, filed Jun. 22, 2012, which is hereby incorporated by reference herein in its entirety.

What is claimed is:

1. A sheet conveying apparatus that conveys a sheet along a conveying path, the apparatus comprising:

a first conveying guide that has a first conveying face of the conveying path;

a second conveying guide that has a second conveying face opposed to the first conveying face; and a guide portion that is provided at any one of the first conveying guide and the second conveying guide, wherein the guide portion has an elastic member that is fixed to one of the first conveying guide and the second conveying guide, and a rigid member that is provided on the face side of the elastic member on which the sheet passes and that has a surface more rigid than that of the elastic member, and wherein the elastic member is deformed by pressing of the conveyed sheet when the sheet passes through the guide portion.

2. The sheet conveying apparatus according to claim 1, wherein the rigid member is overlapped and combined with the elastic member, and is fixed on the elastic member and integrated with the elastic member at a part of the area overlapped with each other, and is not fixed on the elastic member but can be separated from the elastic member at the other part of the area overlapped with each other, and the elastic member at the other part is bent by pressing of the conveyed sheet.

3. The sheet conveying apparatus according to claim 1, wherein a width of the elastic member in a direction perpendicular to a conveying direction of the sheet is wider than that of the rigid member, and an end portion of the rigid member in the width direction is positioned inside an end portion of the elastic member in the width direction.

4. The sheet conveying apparatus according to claim 1, wherein an end portion of the rigid member on the downstream side in the conveying direction of the sheet is positioned inside an end portion of the elastic member on the downstream side.

5. The sheet conveying apparatus according to claim 1, wherein the rigid member has a convex bent portion on a face side on which the sheet passes.

6. The sheet conveying apparatus according to claim 1, wherein the rigid member has a curved portion on a face side on which the sheet passes.

7. The sheet conveying apparatus according to claim 1, wherein the plurality of guide portions is provided in a direction perpendicular to the conveying direction of the sheet, an elastic force of the guide portion is stronger than elastic forces of the thinnest sheet used in the sheet conveying apparatus and the sheet with the same width as that of the guide portion in each of the guide portions, and is weaker than an elastic force of the thickest sheet used in the sheet conveying apparatus in all the guide portions.

8. The sheet conveying apparatus according to claim 1, further comprising a pair of rollers that nip and convey the sheet, wherein the guide portion guides the sheet to the nip portion of the pair of rollers.

9. The sheet conveying apparatus according to claim 1, wherein rigidity of the rigid member is higher than that of the elastic member.

10. The sheet conveying apparatus according to claim 1, wherein the elastic member is a resin film.

11. The sheet conveying apparatus according to claim 1, wherein the rigid member is a metal thin plate.

12. An image reading apparatus comprising:

the sheet conveying apparatus according to claim 1; and an image reading portion that reads an image of a sheet conveyed by the sheet conveying apparatus.

13. A sheet conveying apparatus comprising:

a conveying guide that guides a sheet to be conveyed;

a resin film that is provided on the conveying guide and can be deformed; and a metal plate that is provided on a face side of the resin film on which the sheet passes.

14. The sheet conveying apparatus according to claim 13, wherein the metal plate is overlapped and combined with the resin film, and is fixed on the resin film and integrated with the resin film at a part of area overlapped with each other, and is not fixed on the resin film but can be separated from the elastic member at the other portion of the area overlapped with each other, and the resin film at the other portion is deformable.

15. The sheet conveying apparatus according to claim 13, wherein a width of the resin film in a direction perpendicular to a conveying direction of the sheet is wider than a width of the metal plate, and an end portion of the metal plate in the width direction is positioned inside an end portion of the resin film in the width direction.

16. The sheet conveying apparatus according to claim 13, wherein an end portion of the metal plate on the downstream side in the conveying direction of the sheet is positioned inside an end portion of the resin film on the downstream side.

17. The sheet conveying apparatus according to claim 13, wherein the metal plate has a convex bent portion on a face side on which the sheet passes.

18. The sheet conveying apparatus according to claim 13, wherein the metal plate has a curved portion on a face side on which the sheet passes.

19. The sheet conveying apparatus according to claim 13, further comprising a pair of rollers that nip and convey the sheet, wherein the guide portion guides the sheet to the nip portion of the pair of rollers.

* * * * *